US008115690B2

(12) United States Patent
Koh et al.

(10) Patent No.: US 8,115,690 B2
(45) Date of Patent: Feb. 14, 2012

(54) COUPLED MULTIBAND ANTENNA

(75) Inventors: Boon Ping Koh, Petaling Jaya (MY); Sooliam Ooi, Plantation, FL (US)

(73) Assignee: Motorola Solutions, Inc., Schaumburg, IL (US)

( * ) Notice: Subject to any disclaimer, the term of this patent is extended or adjusted under 35 U.S.C. 154(b) by 581 days.

(21) Appl. No.: 12/360,937

(22) Filed: Jan. 28, 2009

(65) Prior Publication Data

US 2010/0188303 A1 Jul. 29, 2010

(51) Int. Cl.
*H01Q 1/24* (2006.01)
*H01Q 1/36* (2006.01)
*H01Q 21/30* (2006.01)

(52) U.S. Cl. ..... 343/702; 343/725; 343/895

(58) Field of Classification Search ..... 343/702, 343/722, 725, 729, 749, 790–792, 826, 827, 343/831, 872, 873, 895
See application file for complete search history.

(56) References Cited

U.S. PATENT DOCUMENTS

| | | | | |
|---|---|---|---|---|
| 4,800,395 | A * | 1/1989 | Balzano et al. | 343/895 |
| 5,923,305 | A | 7/1999 | Sadler | |
| 6,107,970 | A * | 8/2000 | Holshouser et al. | 343/702 |
| 6,130,651 | A * | 10/2000 | Yanagisawa et al. | 343/895 |
| 6,275,198 | B1 * | 8/2001 | Kenoun et al. | 343/895 |
| 6,329,954 | B1 | 12/2001 | Fuchs et al. | |
| 6,559,811 | B1 | 5/2003 | Pulimi et al. | |
| 6,628,241 | B1 * | 9/2003 | Fukushima et al. | 343/895 |
| 6,765,536 | B2 * | 7/2004 | Phillips et al. | 343/702 |
| 7,053,839 | B2 * | 5/2006 | Cassel et al. | 343/702 |
| 2003/0210206 | A1 | 11/2003 | Phillips | |
| 2004/0070548 | A1 | 4/2004 | Cake | |
| 2005/0195119 | A1 | 9/2005 | Gaucher et al. | |
| 2005/0195124 | A1 | 9/2005 | Puente Baliarda | |
| 2006/0050009 | A1 | 3/2006 | Ho et al. | |

FOREIGN PATENT DOCUMENTS

| | | | |
|---|---|---|---|
| GB | 2380327 | A | 2/2003 |
| JP | 10-313209 | A | 11/1998 |

OTHER PUBLICATIONS

PCT International Search Report Dated Sep. 30, 2010.

SooLiam Ooi; BoonPing Koh; "Single-fed Dual Band UHF-GPS Helical Antenna"; Antenna Technology Small Antennas and Novel Metamaterials, 2006 IEEE International Workshop on Mar. 6-8, 2006 pp. 184-187.

Ooi, Grossman and Koh; "Dual Band UHF-GPS Folded Monopole Antenna"; IEEE Antennas and Propagation Society International Symposium, Jun. 2007. pp. 1237-1240.

* cited by examiner

*Primary Examiner* — Michael C Wimer
(74) *Attorney, Agent, or Firm* — Anthony P. Curtis; Daniel R. Bestor

(57) ABSTRACT

Free space antenna structures are presented in which multiple radiating elements are disposed proximate to each other. In a structure containing two radiating elements, the radiating element of shorter wavelength is split into a monopole and a dipole that are electrically, but not physically, coupled to each other. The monopole has a length of λ/4 and is attached to the same feed as the longer wavelength radiating element. The dipole has a length of λ/4 and is attached to the same feed as the longer wavelength radiating element. Non-conductive shields prevent contact between the monopole, dipole, and longer wavelength radiating element. The longer wavelength radiating element is formed in a helix outside of which the dipole, and perhaps monopole, is disposed.

18 Claims, 16 Drawing Sheets

COUPLED MULTIBAND ANTENNA

TECHNICAL FIELD

The present application relates to antennas. More specifically, the application relates to a multiband antenna containing a coupled radiating element.

BACKGROUND

With the recent increase in portability of communication devices, it has been desirable to provide communications in different frequency bands. Such an arrangement permits communications in different locations around the world in which one or more of the different bands are used, provides a backup so that the same information can be provided at the different bands, or permits different types of information to be provided to the device at the different frequencies.

In many instances, for example due to space/design considerations, it is desirable to limit the number of separate antennas to a single combined structure that functions in the multiple bands. One particularly useful combination of bands includes very high frequency (VHF) band (about 136-174 MHz) and the global positioning satellite (GPS) band (about 1575 MHz, 10 times higher than the VHF band). This combination is particularly desirable for public safety providers (e.g., police, fire department, emergency medical responders, and military) who have used the VHF band maintained exclusively for public safety purposes. With the advent of GPS, it has become desirable to be able to determine locations of the public safety providers to better manage increasingly scarce resources, coordinate quicker response, and guide personnel safely through potentially dangerous situations.

It is especially challenging however to combine individual antennas with these bandwidths into a single structure. To be an effective radiator, antennas (also called radiating elements) have electrical lengths of $\lambda/4$. Thus, a VHF radiating element has a relatively long electrical length of $\lambda/4$ at the center of the VHF band, or about 50 cm, while the GPS radiating element of $\lambda/4$ is about 5 cm.

Unlike the VHF radiating element, the peak gain of the GPS radiating element is directed upward (away from feed point or the base of the radiating element) toward the GPS satellites. Unfortunately, the upward pointing antenna peak gain of GPS radiating elements of length $\lambda/4$ is relatively low in antenna structures combining VHF and GPS radiating elements. Simulations have shown that it would be desirable to extend the length of the GPS radiating element to $3\lambda/4$ at the center of the GPS band to increase this gain and improve the upward radiation pattern. However, increasing this length to $3\lambda/4$ detrimentally affects the performance in both bands when implemented in certain structures. Specifically, in these structures, the GPS radiating element consumes the majority of the current when attempting to excite the VHF radiating element, thereby suppressing the gain of the VHF radiating element. Further, in some of these certain structures, exciting the GPS radiating element instead excites the VHF radiating element, decreasing the gain of the GPS radiating element.

Accordingly, it is desirable to provide a combined antenna structure that has sufficient peak gain for multiple frequency bands while retaining a relatively small form factor.

BRIEF DESCRIPTION OF THE DRAWINGS

Embodiments will now be described by way of example with reference to the accompanying drawings, in which.

DETAILED DESCRIPTION

Free space antenna structures are presented in which multiple radiating elements are disposed proximate to each other. At least one of the radiating elements is split into a monopole and a dipole that are electrically, but not physically, coupled to each other. The radiating element having the longer wavelength may be compressed into a helical structure (helix) to reduce the physical length of the radiating element without reducing the electrical length. One or more sections of the shorter wavelength radiating element may be disposed outside this helix. The monopole, which is shorter than the dipole, drives the dipole at the fundamental resonant frequency. The radiating element having the longer wavelength does not drive either the monopole or the dipole.

Figure 1:
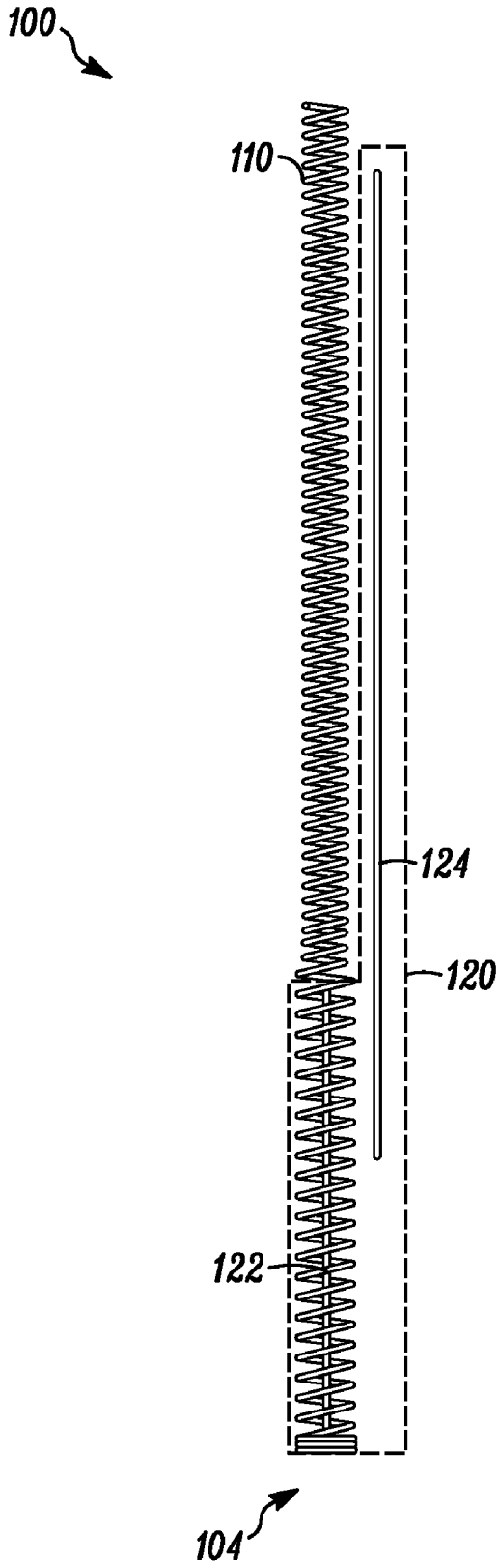
FIG. 1 is a side view of an embodiment of a combined antenna structure.

FIG. 1 illustrates a side view of one embodiment of a free space combined antenna structure. The free space antenna structure is formed from individual conductive wires and assembled rather than being fabricated, for example, by deposition on a multilayer substrate. The antenna structure 100 contains first and second radiating elements 110, 120. The first and second radiating elements 110, 120 are connected to other circuitry and electronics (not shown) at a base 104 of the antenna structure 100.

The first radiating element 110 is, for example, a VHF antenna whose fundamental resonance is at VHF band frequencies. The VHF radiating element 110 is coiled into a helical spiral to compress the length of the VHF radiating element 110. The uncoiled length of the VHF radiating element 110 is $\lambda_{longer}/4$ (about 50 cm) while the length of the helix is much less (e.g., 16 or 18 cm). As used herein, the wavelength, λ, is the fundamental resonant frequency of the radiating element. This allows the VHF radiating element 110 to be accommodated within a much shorter physical length than the electrical length, allowing the VHF radiating element 110 to be implemented in portable electronics in which design considerations require a much shorter antenna. Although a helix is shown, other structures that compress the length of the radiating element (e.g., an element that extends back and forth multiple times laterally along the length of the structure) may be used instead or in addition to the helical element. Such structures may be used as long as desired electrical and physical antenna characteristics such as gain, radiation pattern, and form factor are able to be maintained.

The second radiating element 120 is, for example, a GPS antenna whose fundamental resonance is at GPS band frequencies. The second radiating element 120 contains two sections: a first section 122 (also called a stub) coupled to the base 104 of the antenna structure and a second section 124. The second section 124 is floating, i.e., it is proximate enough to the first section 122 to be electrically coupled to and driven by the first section 122, but does not physically contact the first section 122 (or the VHF radiating element 110). The first section 122 drives the second section 124 at the fundamental resonant frequency. The fundamental resonant frequencies of the first and second radiating elements 110, 120 are unrelated to each other (i.e., not harmonics). The first section 122 is, as shown in FIG. 1, a monopole wire whose length is $\lambda_{shorter}/4$, or about 5 cm. As this length is much less than that of the VHF radiating element 110, the first section 122 is able to be disposed within the helix of the VHF radiating element 110 without extending from the VHF radiating element 110. The first section 122 shares the same feed as the first radiating element 110.

The second section 124, shown in FIG. 1, is a dipole wire whose length of the second section 124 is $\lambda_{shorter}/2$, or about 10 cm. The second section 124 overlaps the first section 122 sufficiently to electrically couple to the first section 122 but does not physically contact the first section 122. This is to say that although the second section 124 does not contact the first section 122, the monopole wire 122 inside the helix serves to excite the dipole wire 124. As shown, the monopole and dipole overlap each other laterally, i.e., along the direction of extension of the wires from the end of the monopole connected to the base 104 to the end of the dipole most distal from the base 104. As above, although the monopole and dipole are illustrated as straight wires, other shapes may be used as long as desired electrical and physical antenna characteristics such as gain, radiation pattern, and form factor are able to be maintained.

The second section 124, as can be seen, is external to the helix. Thus, the total electrical length of the second radiating element 120 is $3\lambda_{shorter}/4$ of the center GPS frequency, only $\lambda_{shorter}/4$ of which is disposed within the helix. Although it is shown as floating in FIG. 1, the second section 124 is retained in the antenna structure 100 through any manner (e.g., retained between non-conductive inner and outer sleeves) as long as it does not electrically contact the first section 122 or the VHF radiating element 110. For example, non-conductive shrink tubing may be used to retain the second section 124 in the desired location.

Figure 2:
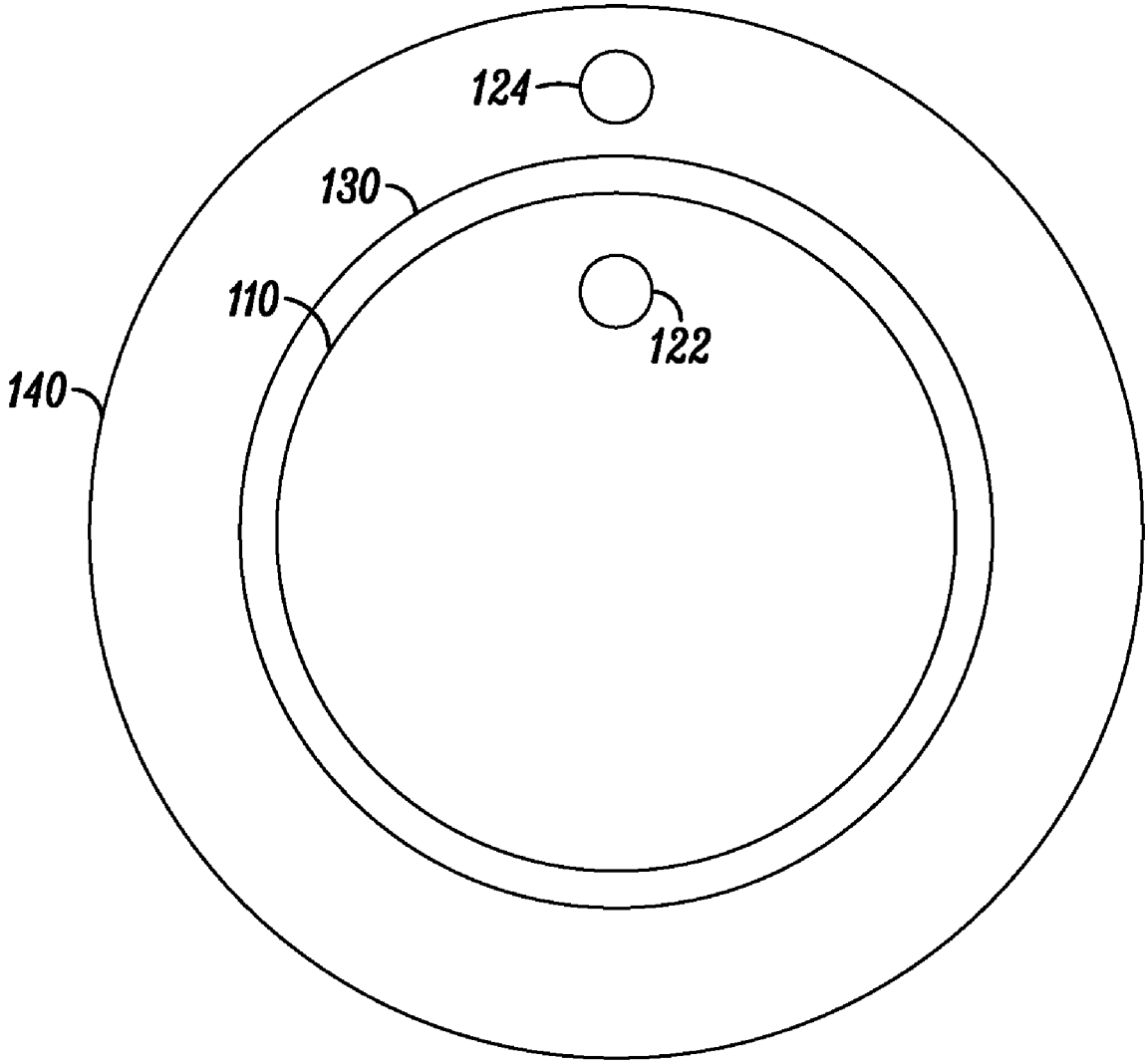
FIG. 2 is a top view of the combined antenna structure of FIG. 1.

A top view of the embodiment shown in FIG. 1 is illustrated in FIG. 2. As shown, the first section 122 of the second radiating element 120 is disposed within the helix forming the first radiating element 110 and the second section 124 of the second radiating element 120 is disposed outside of the helix. The second section 124 is separated from the first radiating element 110 by a non-conductive sheath 130. The sheath 130 extends along substantially the entire length of the first radiating element 110, although it may be shortened to extend only to cover the portion of the first radiating element 110 that overlaps with the second section 124 of the second radiating element 120. The first section 122 of the second radiating element 120 is disposed proximate to the coils of the helix where the second section 124 is disposed to sufficiently couple to the second section 124. A non-conductive cover 140 is disposed around the entire antenna structure 100 and retains the second section 124. An additional non-conductive cover (not shown) may be disposed around the first section 122 between the first section 122 and the first radiating element 110.

Figure 3:
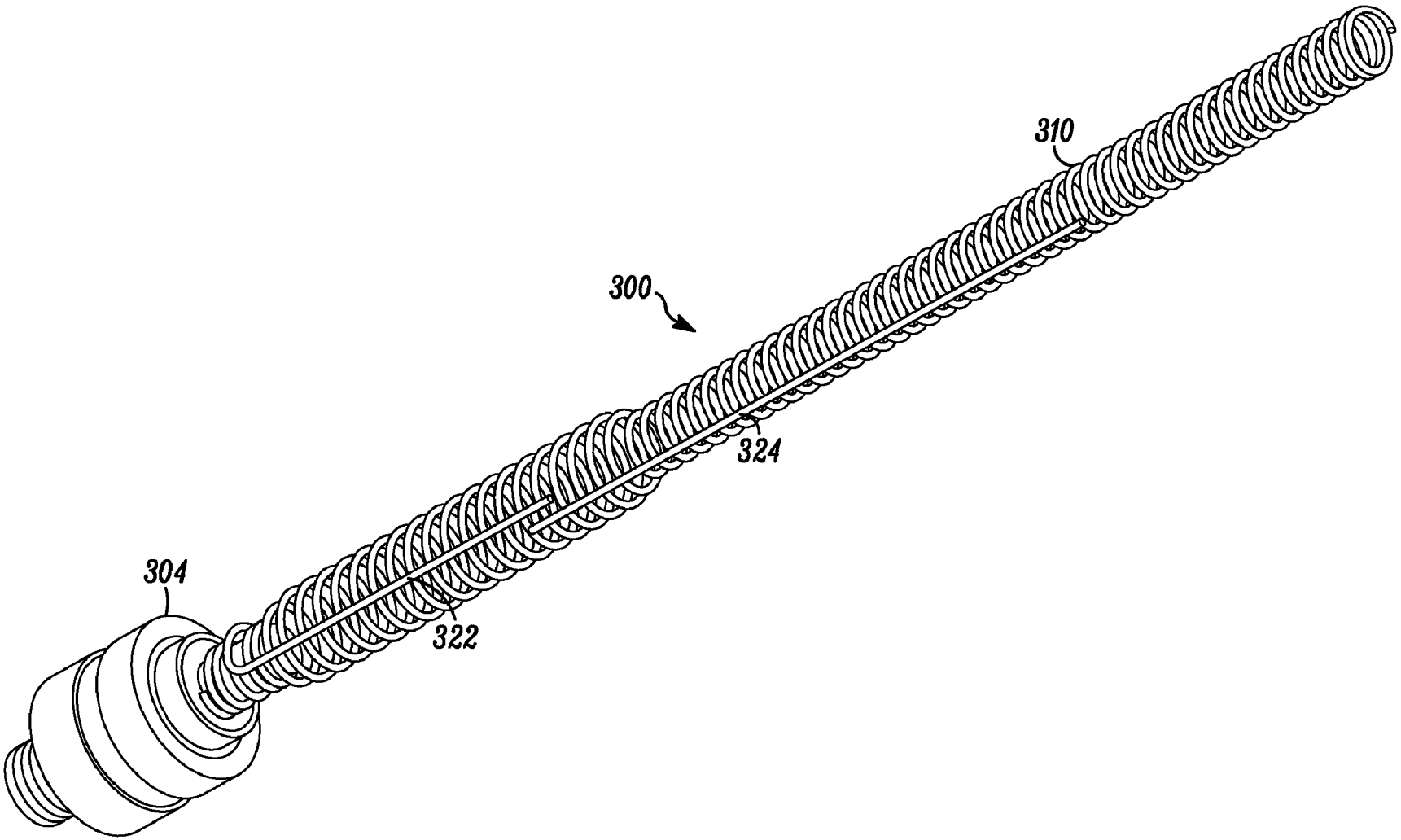
FIG. 3 is a perspective view of an embodiment of a combined antenna structure.

Another embodiment of a combined free space antenna structure is illustrated in the perspective view of FIG. 3. The combined antenna structure 300, like the combined antenna structure 100 of FIG. 1, contains a first radiating element 310 and first and section sections 322, 324 forming a second radiating element 320. The first radiating element 310 is, as in the above example, a $\lambda_{longer}/4$ VHF antenna that provides resonance in VHF band frequencies and is coiled into a helical spiral. The first and second sections 322, 324, as in the example above, are non-physically contacting, electrically coupled monopole and dipole wires (respectively) that overlap and form a total electrical length of $3\lambda_{shorter}/4$. The first section 322 drives the parasitic second section 324. The first radiating element 310 and first section 322 of the second radiating element 320 are supplied with current at the base 304 of the antenna structure 300 by the same feed 306 (shown in FIGS. 4 and 5). The overlapping portions of the first and second sections 322, 324 may be disposed radially adjacent to each other and may have a fitted sleeve therebetween. Similar to the embodiment of FIG. 1, the total physical length of the first and section sections 322, 324 is about ⅔ that of the first radiating element 310 (although this can differ, depending on the diameter and distance between adjacent coils of the helix). However, in the embodiment of FIG. 3, the first and section sections 322, 324 both lie outside the helix of the first radiating element 310.

Figure 4:
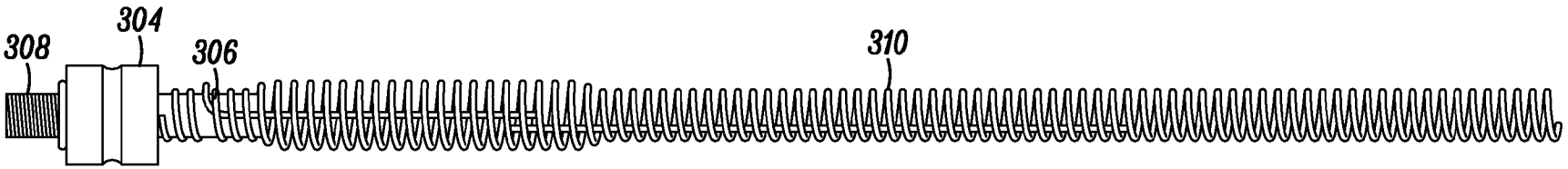
FIG. 4 is a side view of the embodiment of FIG. 2 showing the first radiating element.
Figure 5:
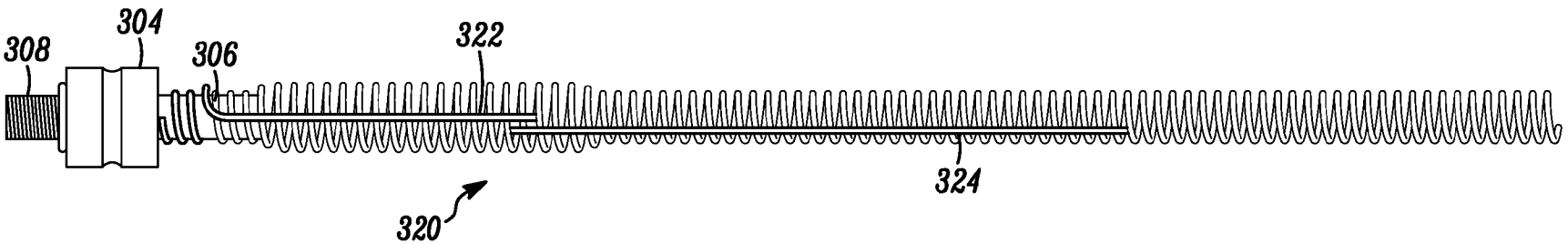
FIG. 5 is a side view of the embodiment of FIG. 2 showing the second radiating element.

As shown in the side views of FIGS. 4 and 5, the base 304 has a connection portion 308 that may be inserted into a portable electronic communication device, such as a push-to-talk (PTT) device used by public safety personnel. The connection portion 308 is shown as having threads for a screw-type connector, however other types of connectors, such as snap-fit connectors may be used for easy connection to the body of the portable communication device. The first radiating element 310 is shown in FIG. 4 as being connected to the base 304 of the antenna structure 300 by the feed 306. Similarly, the second radiating element 320 is shown in FIG. 5 as being connected to the base 304 of the antenna structure 300 at a portion of the feed point 306 more closely to the connection portion 308 than the first radiating element 310.

Figure 6:
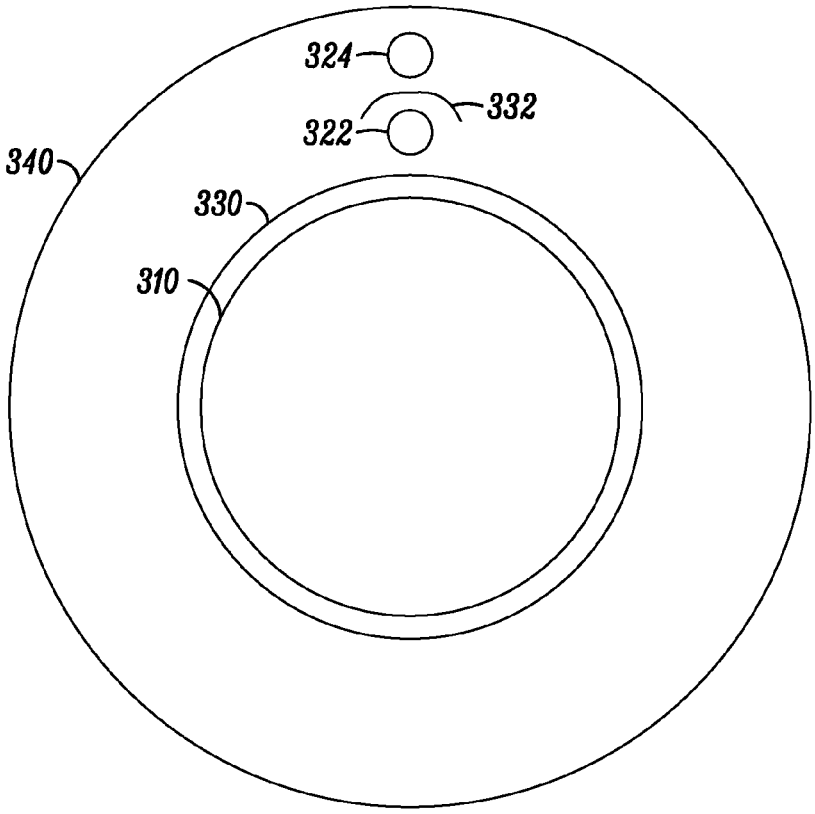
FIGS. 6 and 7 are top views of embodiments of combined antenna structure of variations of FIG. 2.
Figure 7:
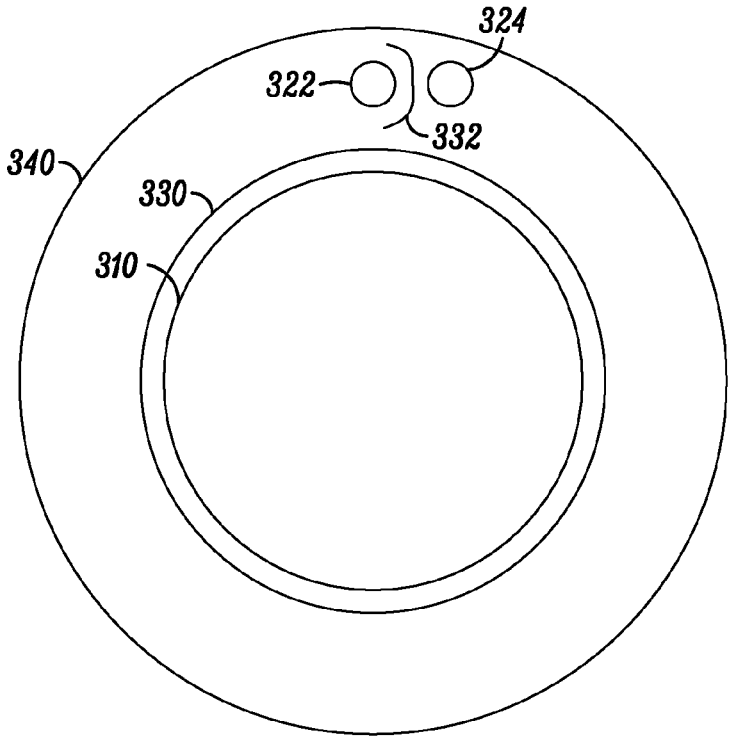

Top views of variations of the embodiment shown in FIGS. 3 and 4 are illustrated in FIGS. 5 and 6. As shown in both variations, both the first and second sections 322, 324 of the second radiating element 320 are disposed outside of the helix of the first radiating element 310. The second radiating element 320 is separated from the first radiating element 310 by a non-conductive sheath 330 that extends along substantially the entire length of the first radiating element 310. As shown in FIG. 6, the first and second sections 322, 324 are disposed radially adjacent and may be separated by a non-conductive shield 332 that extends at least around the overlapping portions of the first and second sections 322, 324. The shield 332 is disposed such that the first and second sections 322, 324 are completely protected from physical contact with each other. As shown in FIG. 7, the first and second sections 322, 324 are disposed circumferentially adjacent with the non-conductive protection 332 extending at least around the overlapping portions of the first and second sections 322, 324. The sheath 330 and protection 332 prevent accidental contact between the various portions of the antenna structure 300 if the antenna structure 300 is bent or otherwise damaged. A non-conductive cover 340 is disposed around the entire antenna structure 300 and retains the second section 324.

In other unshown embodiments, the relative positions of the first and second sections 322, 324 may be reversed from that of FIG. 6 such that the second section 324 is radially closer to the first radiating element 310 than the first section 322. In other embodiments, the protection 332 may extend along either only the overlapping portions of the first and second section 322, 324 or over an extensive amount of the first and/or second section 322, 324. In other embodiments, not shown, the protection 332 may extend entirely around the first or second section 322, 324 further protecting the closer of the two from the first radiating element 310 and from each other, or may be eliminated entirely, e.g., if the first and second sections 322, 324 are sufficiently circumferentially separated from each other.

In each of the embodiments of FIGS. 1-7, the first radiating element 110, 310 is shown as having a non-uniform helical structure. As is apparent, the portion of each first radiating element 110, 310 more proximate to the base 104, 304 of the antenna structure 100, 300 has a diameter larger than the diameter of that distal from the base 104, 304 of the antenna structure 100, 300. Such an arrangement may be desirable, for example, to satisfy a desired form factor of the antenna structure. In other embodiments, a helix having a constant diameter can be used.

Figure 8:
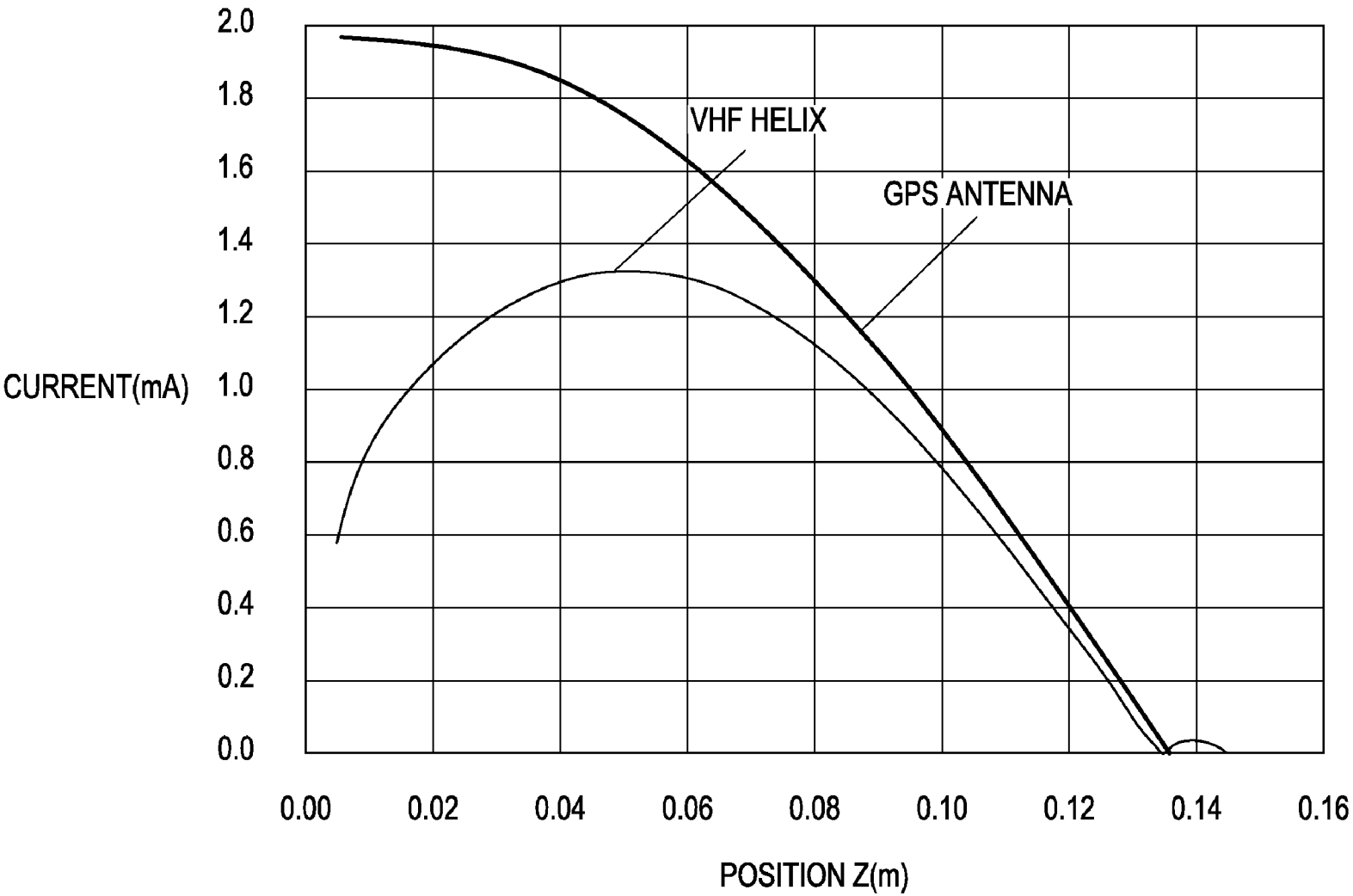
FIG. 8 is a simulation of current distribution in VHF and GPS radiating elements when attempting to excite the VHF radiating element in an embodiment in which a single $3\lambda/4$ GPS monopole wire is disposed within the VHF helix.

Various simulations shown in FIGS. 8-14 are provided using the Method of Moment (MoM). A simulation of the current distribution in a combined antenna structure when attempting to excite the VHF radiating element is shown in FIG. 8. In this structure, a $3\lambda_{shorter}/4$ GPS monopole wire extends through the helix. The monopole wire is a single wire, unlike the embodiments shown in FIGS. 1-7. While such an antenna may be easier to fabricate, the $3\lambda_{shorter}/4$ GPS monopole wire electrically couples to the VHF helix, draining current from the VHF radiating element. Thus, even though it is desired to excite the VHF radiating element, the majority of the current is being undesirably used by the GPS radiating element, leaving the VHF signal dominated by the GPS signal. Similar results were obtained for an embodiment in which the $3\lambda_{shorter}/4$ GPS monopole wire is disposed outside the helix.

Figure 9A:
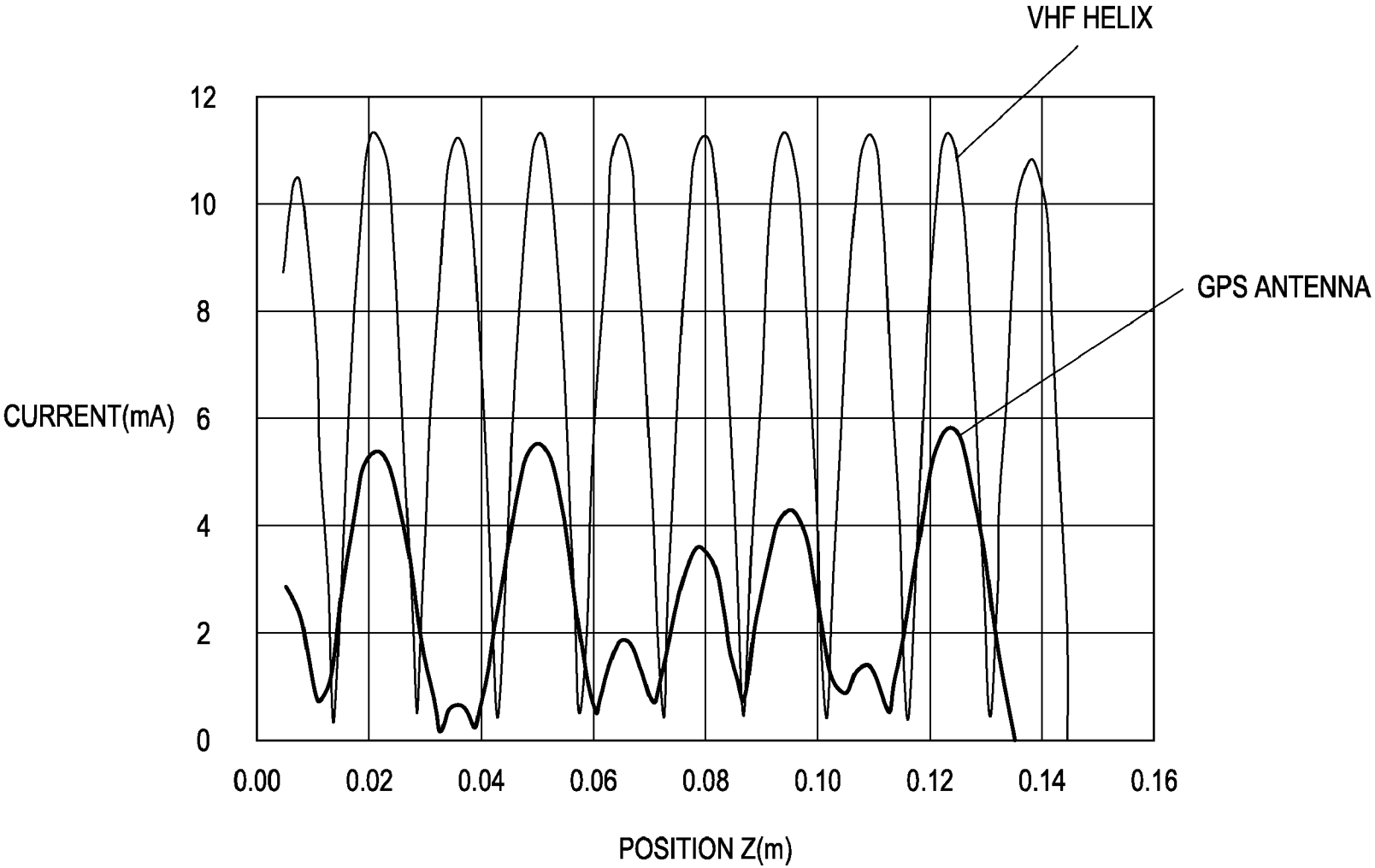
FIGS. 9A and 9B are simulations of current distribution in VHF and GPS radiating elements when attempting to excite the GPS radiating element in embodiments in which a single $3\lambda/4$ GPS monopole wire is disposed within and outside, respectively, the VHF helix.
Figure 9B:
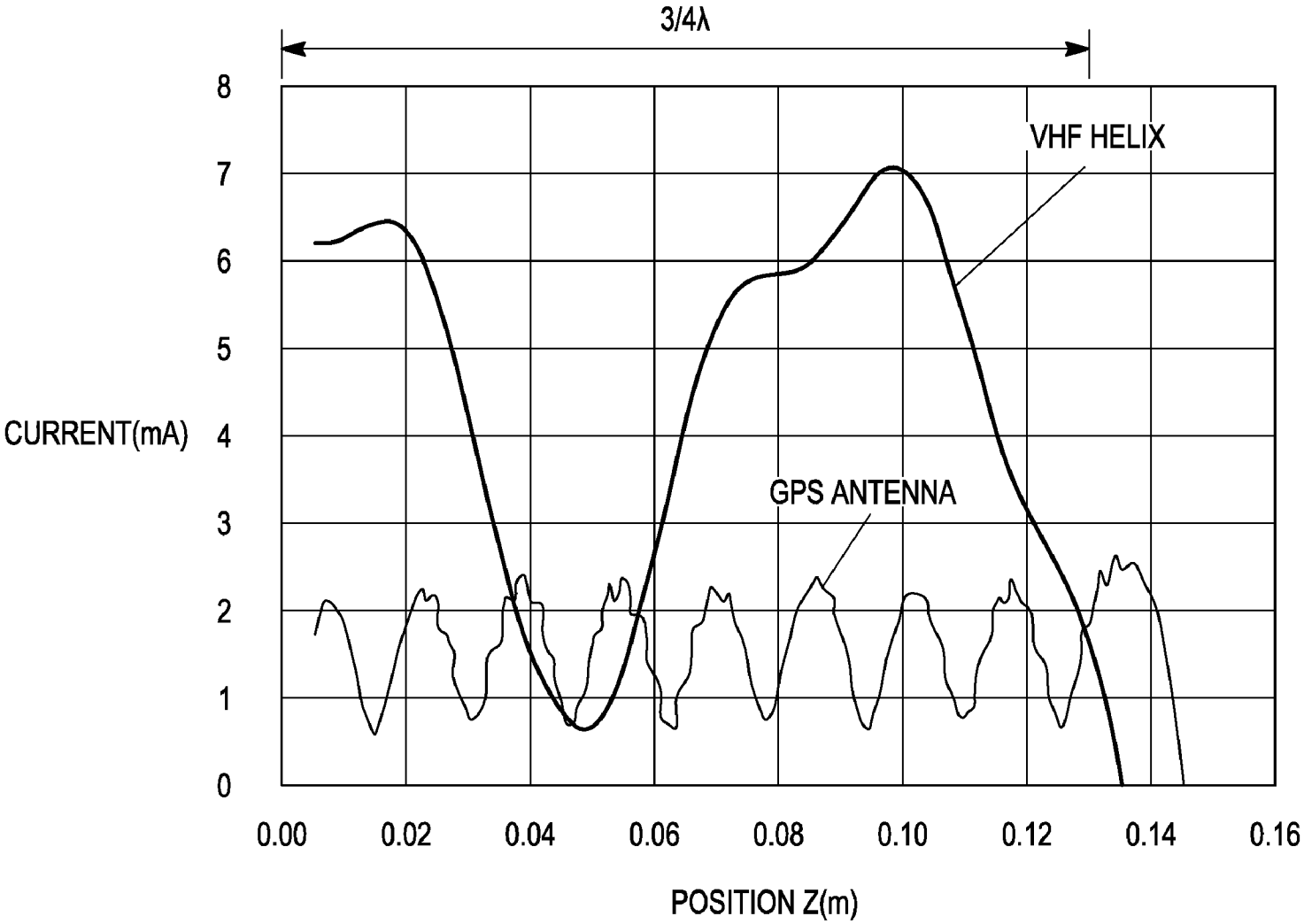

Simulations of the current distribution in a combined antenna structure when attempting to excite the GPS radiating element are shown in FIGS. 9A and 9B. In this structure, a $3\lambda_{shorter}/4$ single GPS monopole wire extends through the helix in FIG. 9A and outside the helix in FIG. 9B. As can be seen in FIG. 9A, the majority of the current is being undesirably used by the VHF radiating element, leaving the GPS signal dominated by the VHF signal. The GPS signal fares better when the $3\lambda/4$ single GPS monopole wire extends outside the helix, as shown in FIG. 9B.

Figure 10A:
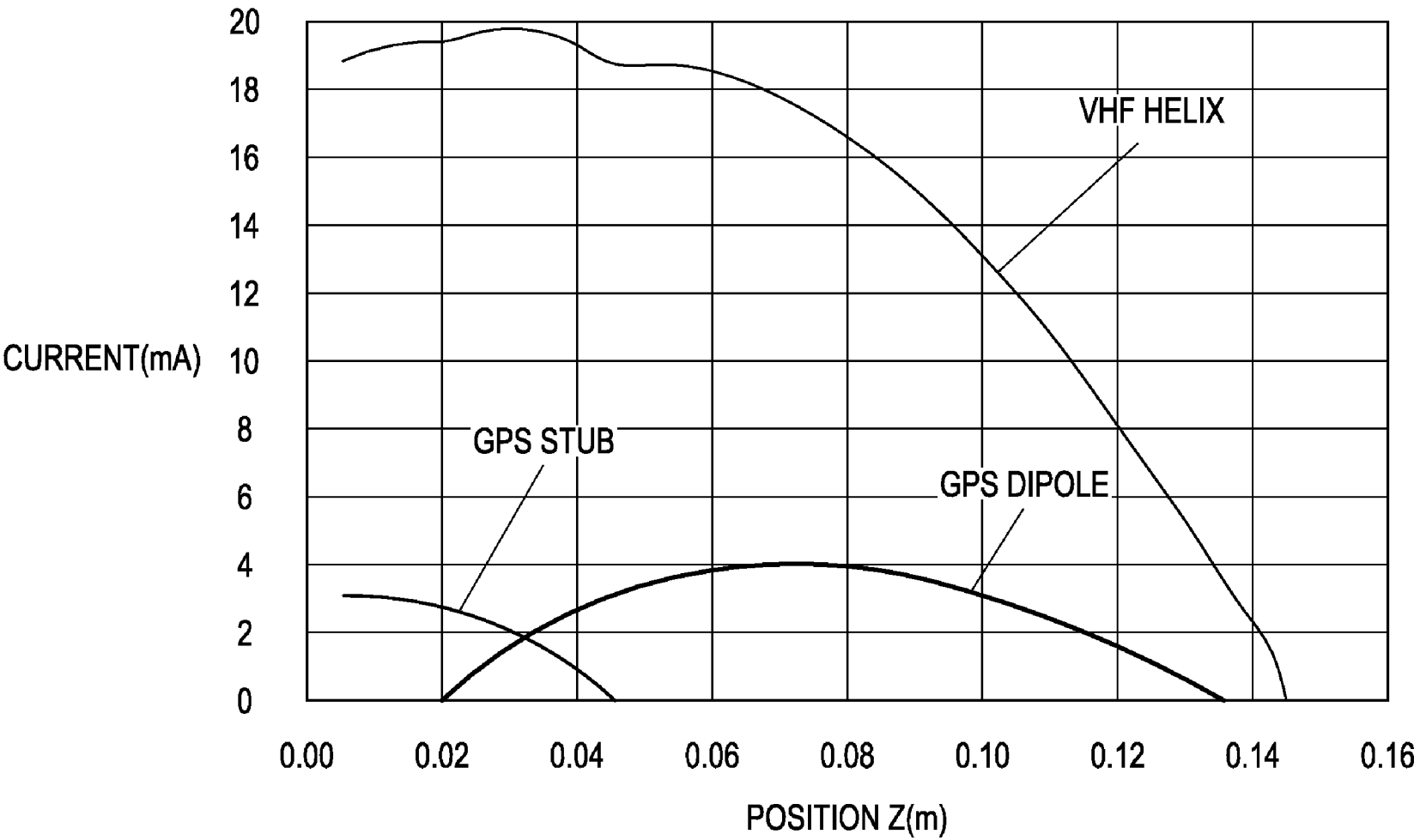
FIGS. 10A and 10B are simulations of current distribution in VHF and GPS radiating elements when attempting to excite the VHF radiating element in the embodiments of FIGS. 1 and 3.
Figure 10B:
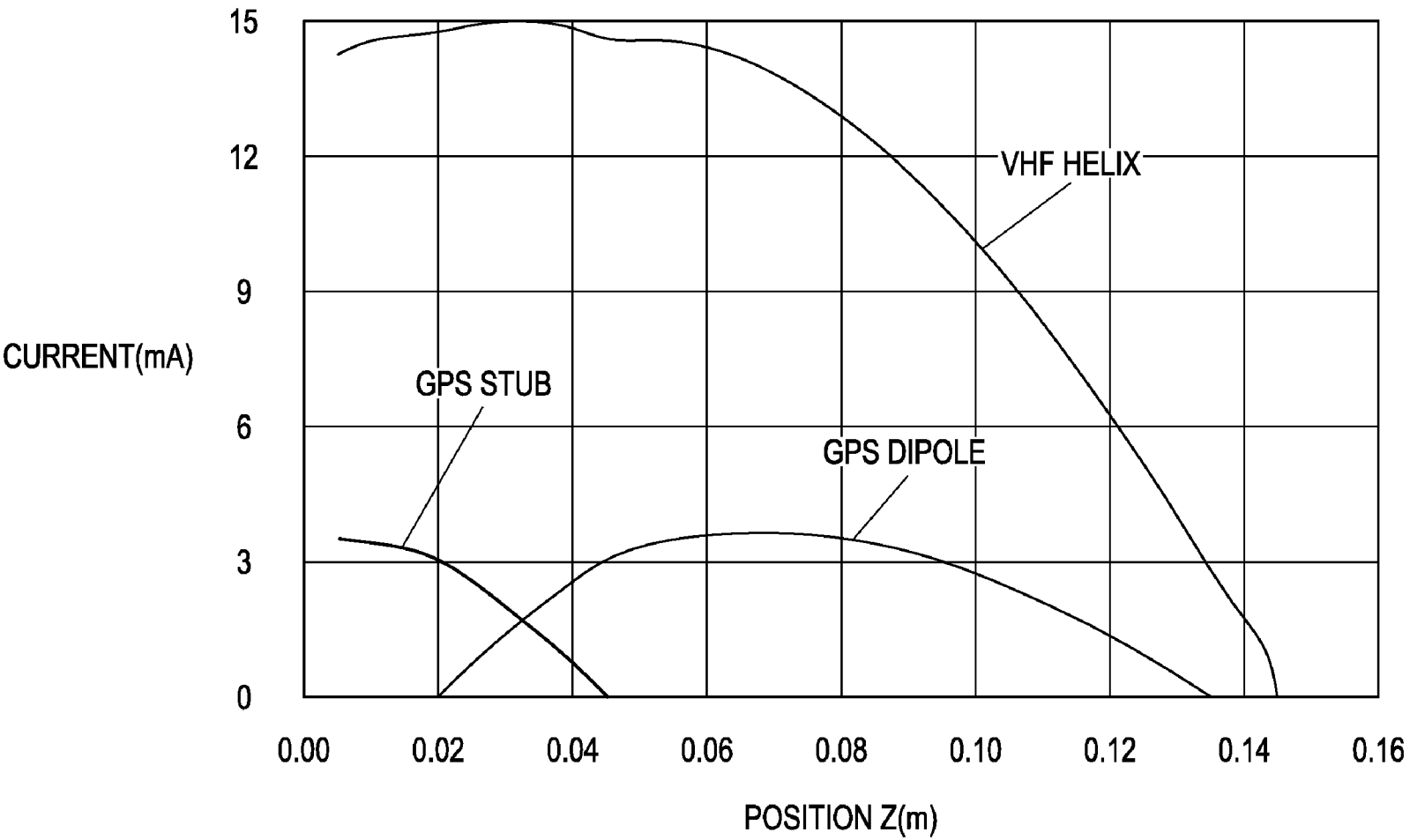

Simulations of the current distribution in the combined antenna structures 100, 300 of FIGS. 1 and 3 when attempting to excite the VHF radiating element are shown respectively in FIGS. 10A and 10B. The coupling impedance between the GPS monopole and GPS dipole is relatively large in the lower frequency range (about 150 MHz), leading to minimal current being induced in the GPS dipole. This is confirmed as shown in the simulation, the majority of the current is now being used by the VHF radiating element. The feed point of the radiating elements is the lower left position (0.0) of the simulations. As each simulation illustrates, the VHF current dominates over the entire length of the VHF antenna, the overlapping current curves at the lower portions of the simulations being the GPS stub and coupled dipole.

Figure 11A:
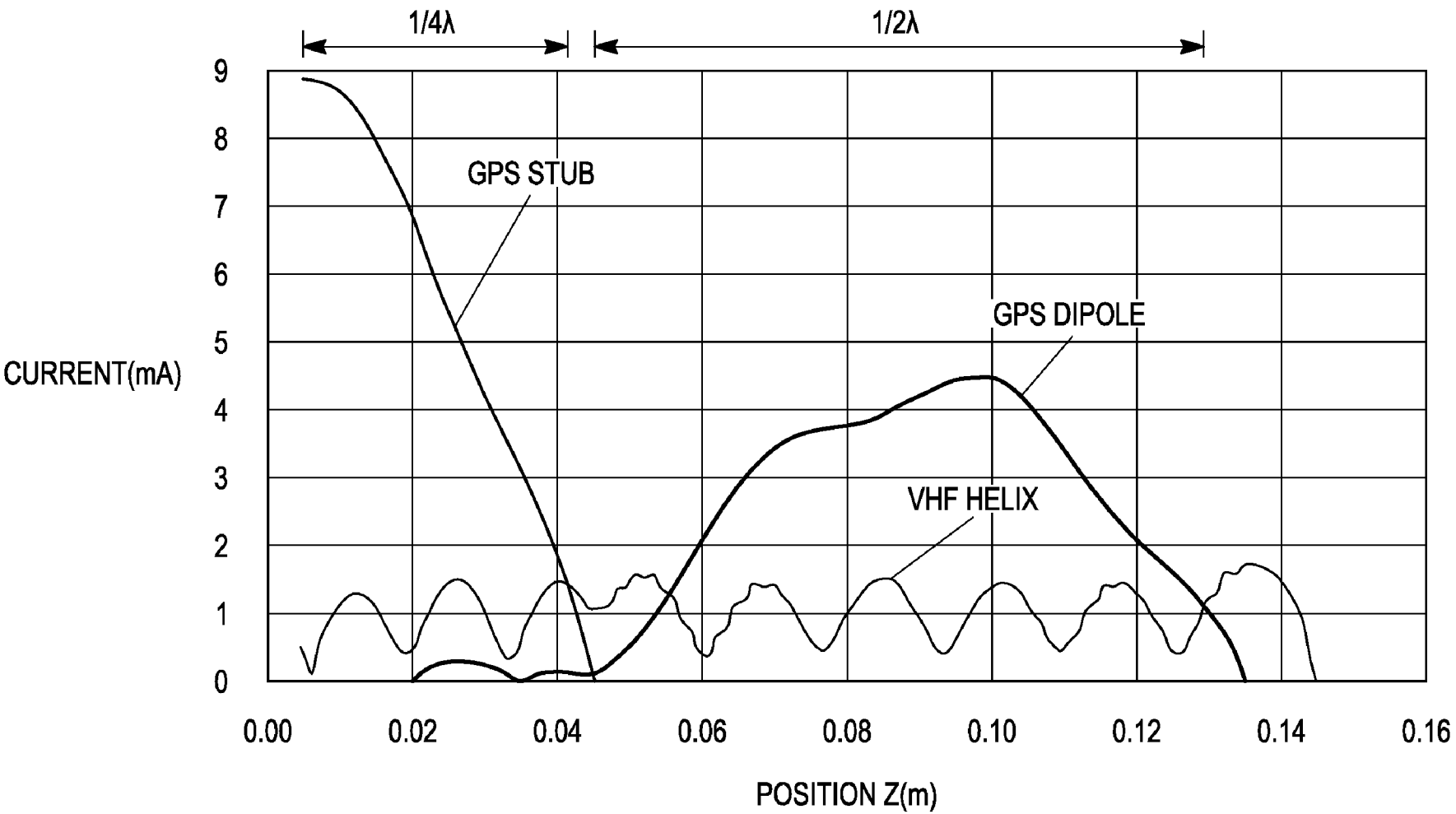
FIGS. 11A and 11B are simulations of current distribution in VHF and GPS radiating elements when exciting the GPS radiating element in the embodiments of FIGS. 1 and 3.
Figure 11B:
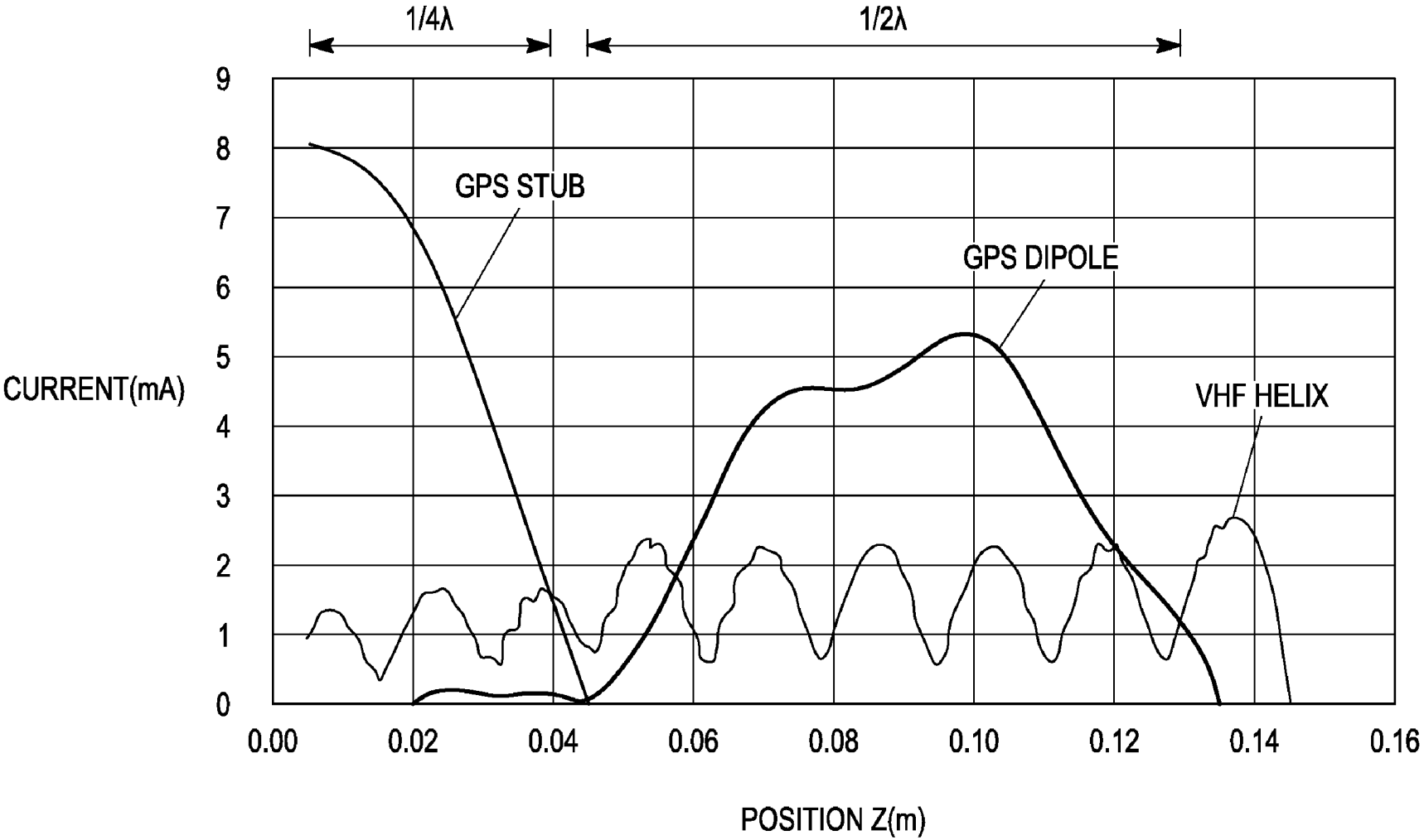

Simulations of the current distribution in the combined antenna structures 100, 300 of FIGS. 1 and 3 when attempting to excite the GPS radiating element are shown respectively in FIGS. 11A and 11B. The coupling impedance between the GPS monopole and GPS dipole is relatively small in the upper, GPS, frequency range (about 1575 MHz), leading to minimal current being induced in the GPS dipole. This is confirmed as shown in the simulation, the majority of the current is being used by the GPS radiating element. The only locations at which the VHF radiating element consumes more current than the GPS radiating elements are at the end points of the dipole.

Figure 12:
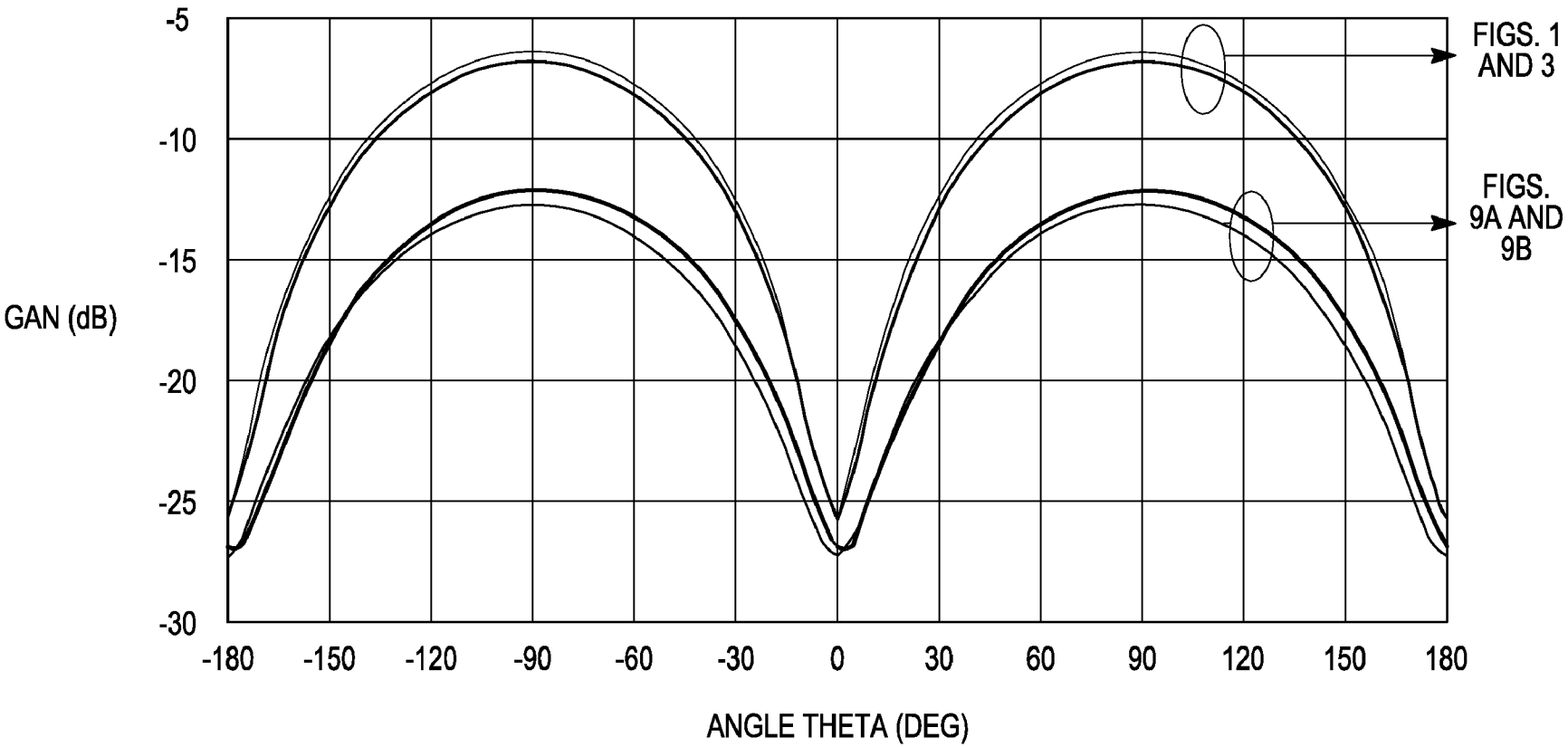
FIG. 12 is a simulation of the VHF gain in the embodiments of FIGS. 1 and 3 and embodiments of FIGS. 9A and 9B.
Figure 13:
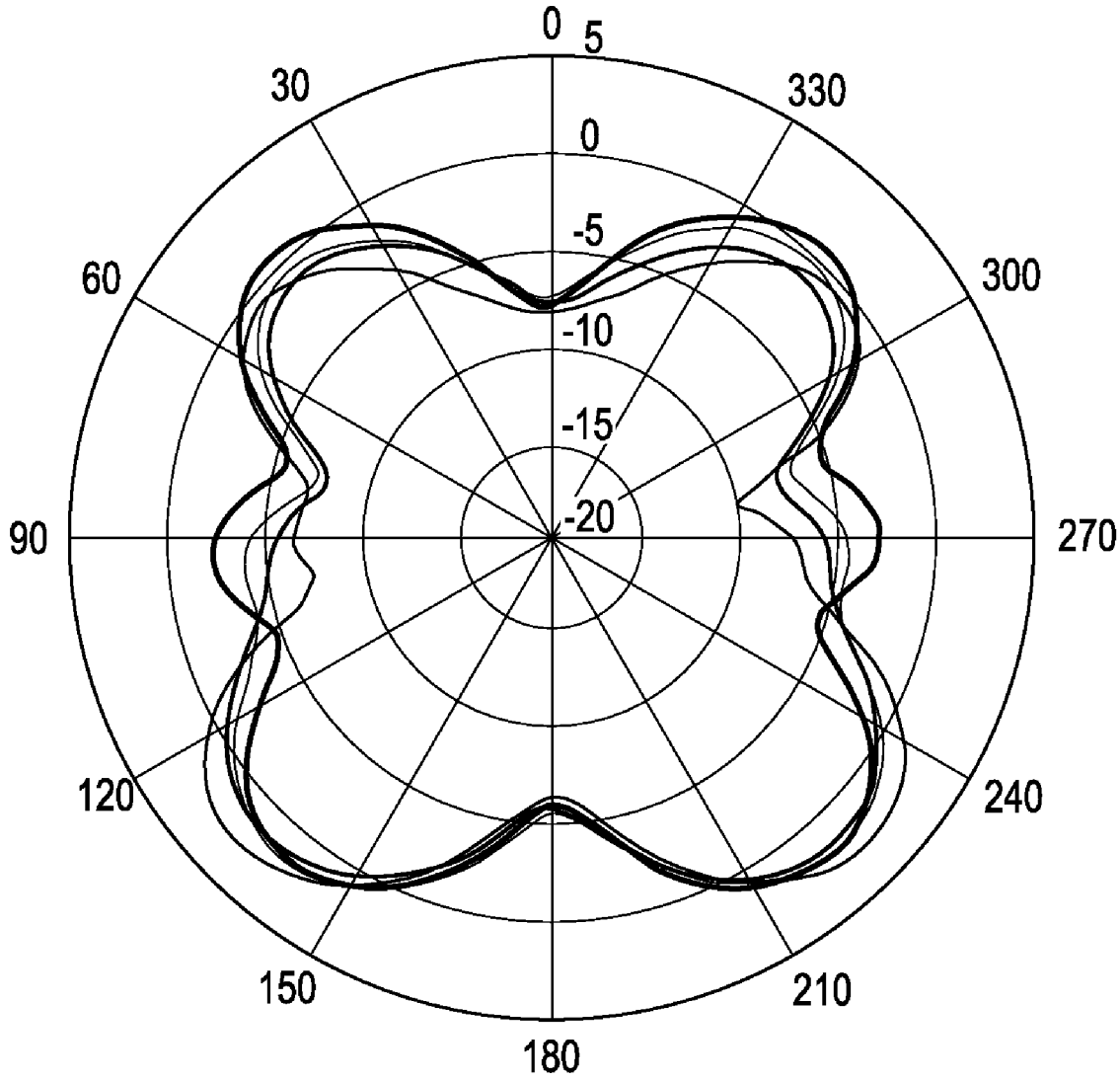
FIG. 13 is a simulation of the GPS gain in the embodiments of FIGS. 1 and 3 and embodiments of FIGS. 9A and 9B.

Comparison simulations of the gain of the different radiating elements at different frequencies for far field radiation patterns are shown in FIGS. 12-13. A comparison simulation of the gain of the VHF radiating element at VHF frequencies (VHF gain) vs. angular distribution is shown in FIG. 12. This simulation illustrates that the VHF gain in the embodiments of FIGS. 1 and 3 is larger than that of embodiments of FIGS. 9A and 9B at all angles (note: $\theta$ is defined along the length of the radiating element). Similarly, a comparison simulation of the gain of the GPS radiating element at GPS frequencies (GPS gain) vs. angular distribution is shown in FIG. 13. This simulation illustrates that the GPS gains in all embodiments are comparable. Similar case for the FIG. 13, it is a far field radiation pattern, but in a polar plot. The FIG. 13 shows a comparable GPS performance.

Figure 14B:
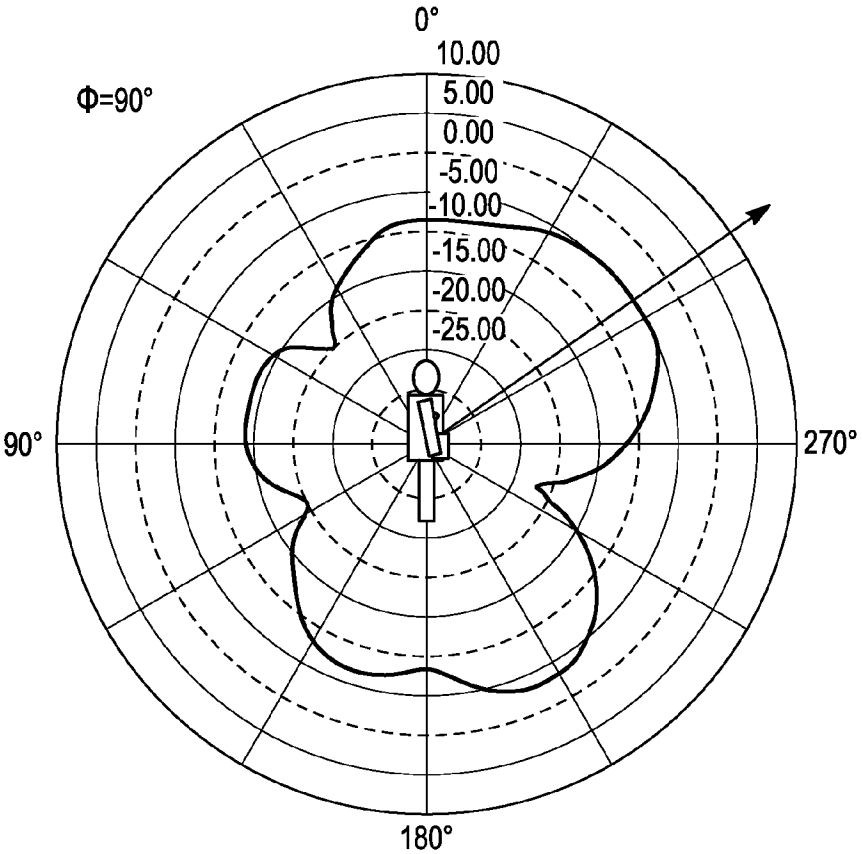
FIGS. 14A and 14B are simulations of GPS radiation patterns at different angles of an embodiment.
Figure 14A:
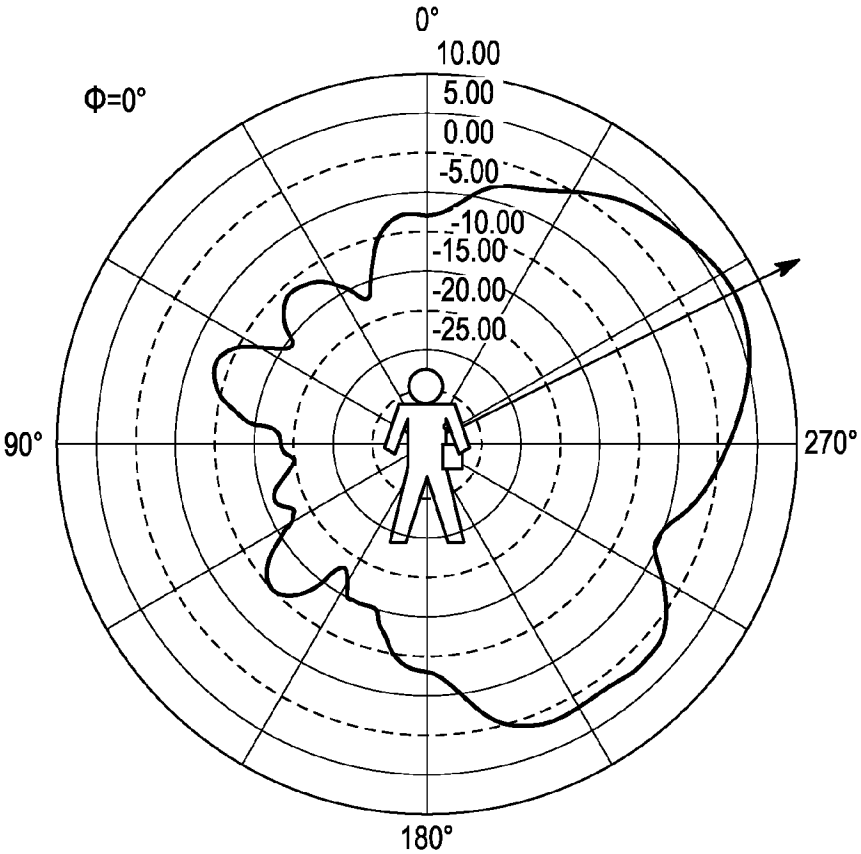

Simulated GPS radiation patterns (at about 1.575 GHz) of the antenna structure of FIG. 3 are shown in FIGS. 14A and 14B. The radiation pattern in an elevation plane through the center of the device is illustrated in both figures. Specifically, FIG. 14A shows the radiation pattern with the figure (in outline) facing into the page and a radio containing the antenna structure facing right ($\phi$=0°), while FIG. 14B shows the radiation pattern with the figure (in outline) facing right and the radio containing the antenna structure facing out of the page ($\phi$=90°). As can be observed, the peak is consistent around 60° from the azimuth.

Figure 15:
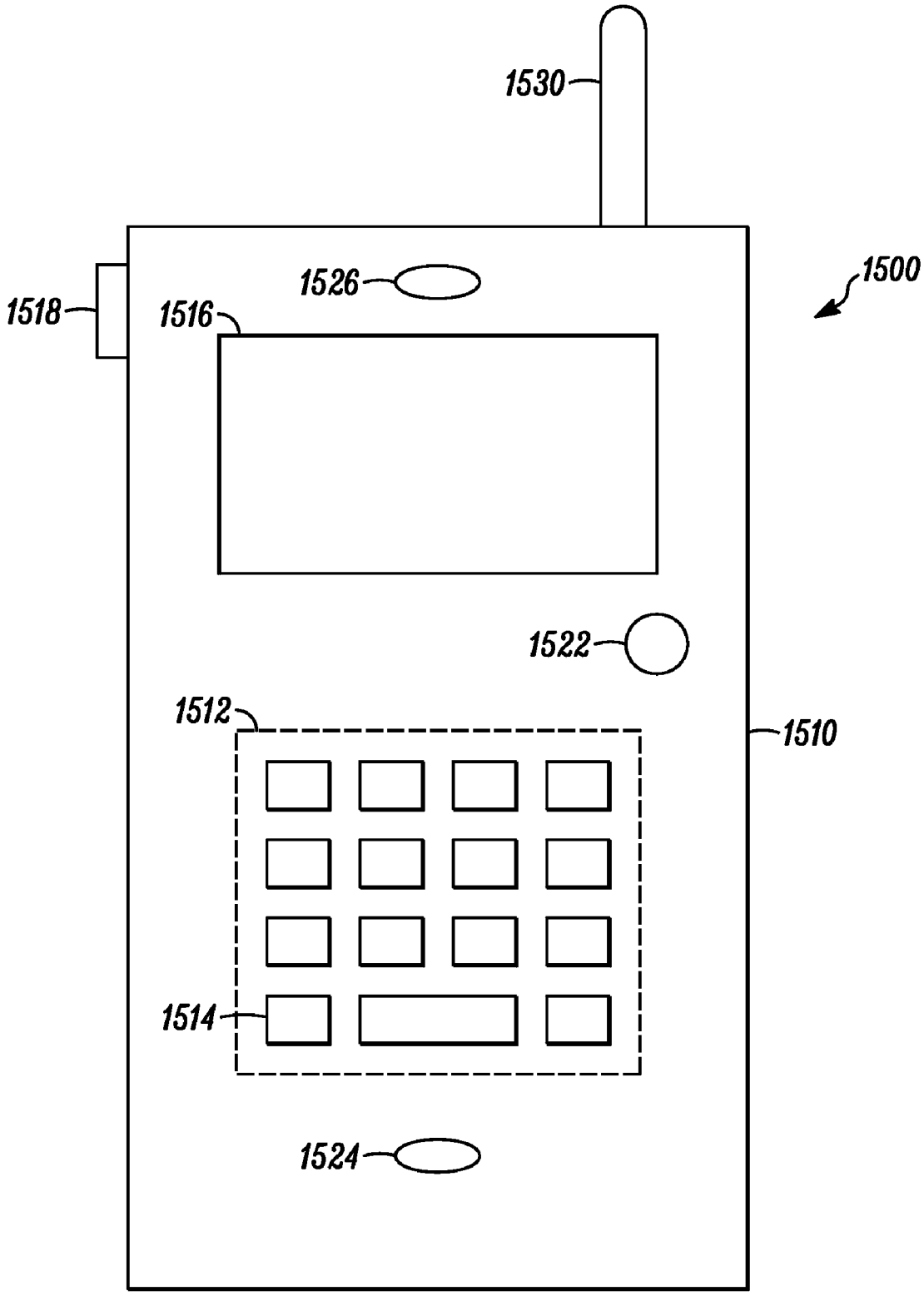
FIG. 15 illustrates an embodiment of a portable communication device containing the antenna structure.

One example of a portable communication device containing the antenna structure of FIG. 1 or 3 is shown in FIG. 15. The communication device 1500 has a body 1510 to which the antenna structure 1530 is connected via, e.g., screwing in the antenna structure 1530. The body 1510 contains internal communication components (such as a microprocessor, transmitter, receiver, and memory) and circuitry to enable the device 1500 to communicate wirelessly with other devices. The body 1510 also contains I/O devices such as a keyboard 1512 with alpha-numeric keys 1514, a display 1516 that displays information about the device 1500, a PTT button to transmit 1518, a channel selector knob 1522 to select a particular frequency for transmission/reception, a microphone 1524, and a speaker 1526. The channel selector knob 1522 and/or keyboard 1512, for example, may be used choose which of the first and second radiating elements in the antenna structure 1530 to use.

Although the above description has focused on VHF/GPS antenna structures due to their use in the public safety environment, similar designs may be used in various antenna structures in which the frequency band difference is large (e.g., UHF/VHF or UHF/GPS). The various wavelength ranges and centers are as follows: VHF (136-174 MHz) center at 150 MHz, UHF (380-520 MHz) center at 450 MHz, 800 MHz (764-870 MHz), GPS (1575 MHz). Thus, for example, in a combined VHF/UHF antenna, the center frequency of the UHF band is 3 times larger than the VHF band, and in a combined UHF/GPS antenna, the center frequency of the GPS band is 3.5 larger than the UHF band. Both of these center frequency differences are sufficient to permit a combined antenna structure to be produced. Such designs include a $\lambda/4$ monopole wire coupled to a $\lambda/2$ dipole to form a $3\lambda/4$ radiating element and effectively decouple the lower-frequency radiating element from the higher-frequency radiating element. Thus, exciting the lower-frequency radiating element will excite the higher-frequency radiating element by a minimal amount. This can also be extended to tri-frequency (or larger) antenna structures. For example, multiband antenna structures such as UHF/800 MHz/GPS, VHF/800 MHz/GPS, VHF/UHF/GPS. Such antenna structures can be used in a variety of situations, for example, to provide a duplicate communication channel in case messages at one of the frequencies are unable to be transmitted/received.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

Those skilled in the art will recognize that a wide variety of modifications, alterations, and combinations can be made with respect to the above described embodiments without departing from the spirit and scope of the invention defined by the claims, and that such modifications, alterations, and combinations are to be viewed as being within the scope of the inventive concept. Thus, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by any claims issuing from this application and all equivalents of those issued claims.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A free space antenna structure comprising:

a first radiating element having a first fundamental frequency with a wavelength of $\lambda_{longer}$, an electrical length of the first radiating element being $\lambda_{longer}/4$;

a second radiating element having a second fundamental frequency with a wavelength of $\lambda_{shorter}$, which is shorter than $\lambda_{longer}$, the first and second fundamental frequencies being unrelated, an electrical length of the second radiating element being $3\lambda_{longer}/4$, the second radiating element having a monopole of electrical length of $\lambda_{shorter}/4$ and a dipole of electrical length $\lambda_{shorter}/2$, the monopole and dipole laterally overlapping such that the monopole and dipole are electrically, but not physically, coupled to each other and the monopole drives the dipole at the second fundamental frequency; and a non-conductive cover surrounding the first and second radiating elements.

2. The antenna structure of claim 1, wherein the first radiating element is formed in a helix and the monopole and dipole extend in the same lateral direction as the helix.

3. The antenna structure of claim 2, wherein the dipole is disposed outside the helix and the monopole is disposed inside the helix.

4. The antenna structure of claim 3, wherein the monopole is offset from the center of the helix such that the monopole is more proximate radially to the dipole than the center of the helix.

5. The antenna structure of claim 2, wherein the monopole and dipole are disposed outside the helix.

6. The antenna structure of claim 5, further comprising a non-conductive shield disposed between the monopole and dipole such that the monopole and dipole are completely protected from physical contact with each other by the non-conductive shield.

7. The antenna structure of claim 5, wherein the monopole is more proximate to the center of the helix than the dipole.

8. The antenna structure of claim 2, further comprising a non-conductive sheath surrounding the helix and disposed between the helix and the dipole.

9. The antenna structure of claim 1, wherein the first radiating element is a VHF antenna and the second radiating element is a GPS antenna.

10. A communication device comprising:

a body containing internal communication components to enable the device to communicate wirelessly with other devices and I/O devices; and a free space antenna structure connected to the body, the free space antenna structure comprising:

a first radiating element having a first fundamental frequency with a wavelength of $\lambda_{longer}$, an electrical length of the first radiating element being $\lambda_{longer}/4$;

a second radiating element having a second fundamental frequency with a wavelength of $\lambda_{shorter}$, which is shorter than $\lambda_{longer}$, the first and second fundamental frequencies being unrelated, an electrical length of the second radiating element being $3\lambda_{longer}/4$, the second radiating element having a monopole of electrical length of $\lambda_{shorter}/4$ and a dipole of electrical length $\lambda_{shorter}/2$, the monopole and dipole laterally overlapping such that the monopole and dipole are electrically, but not physically, coupled to each other and the monopole drives the dipole at the second fundamental frequency; and a non-conductive cover surrounding the first and second radiating elements.

11. The device of claim 10, wherein the first radiating element is formed in a helix and the monopole and dipole extend in the same lateral direction as the helix.

12. The device of claim 11, wherein the dipole is disposed outside the helix and the monopole is disposed inside the helix.

13. The device of claim 12, wherein the monopole is offset from the center of the helix such that the monopole is more proximate radially to the dipole than the center of the helix.

14. The device of claim 11, wherein the monopole and dipole are disposed outside the helix.

15. The device of claim 14, further comprising a non-conductive shield disposed between the monopole and dipole such that the monopole and dipole are completely protected from physical contact with each other by the non-conductive shield.

16. The device of claim 14, wherein the monopole is more proximate to the center of the helix than the dipole.

17. The device of claim 11, further comprising a non-conductive sheath surrounding the helix and disposed between the helix and the dipole.

18. The device of claim 10, wherein the first radiating element is a VHF antenna and the second radiating element is a GPS antenna.

* * * * *